US005434581A

United States Patent [19]

Raguenet et al.

[11] Patent Number: 5,434,581

[45] Date of Patent: Jul. 18, 1995

[54] BROADBAND CAVITY-LIKE ARRAY ANTENNA ELEMENT AND A CONFORMAL ARRAY SUBSYSTEM COMPRISING SUCH ELEMENTS

[75] Inventors: Gérard Raguenet, Eaunes; Frédéric Magnin, Toulouse, both of France

[73] Assignee: Alcatel N.V. Societe Dite, Amsterdam, Netherlands

[21] Appl. No.: 152,380

[22] Filed: Nov. 16, 1993

[30] Foreign Application Priority Data

Nov. 16, 1992 [FR] France ..... 92 13744

[51] Int. Cl.[6] ..... H01Q 1/38; H01Q 1/42

[52] U.S. Cl. ..... 343/700 MS; 343/846; 343/789

[58] Field of Search ..... 343/700 MS, 846, 848, 343/789, 829, 853; H01Q 1/38, 1/42, 1/48

[56] References Cited

U.S. PATENT DOCUMENTS

| | | | |
|---|---|---|---|
| 4,131,894 | 12/1978 | Schiavone | 343/700 MS |
| 4,197,544 | 4/1980 | Kaloi | 343/700 MS |
| 4,605,932 | 8/1986 | Butscher et al. | 343/700 MS |
| 4,709,240 | 11/1987 | Bordenave | 343/772 |
| 4,816,836 | 3/1989 | Lalezari | 343/700 MS |
| 4,990,926 | 2/1991 | Otsuka et al. | 343/700 MS |
| 5,087,920 | 2/1992 | Tsurumaru et al. | 343/700 MS |
| 5,124,713 | 6/1992 | Mayes | 343/700 MS |
| 5,210,542 | 5/1993 | Pett et al. | 343/700 MS |

FOREIGN PATENT DOCUMENTS

| | | |
|---|---|---|
| 0205393A1 | 12/1986 | European Pat. Off. . |
| 0355898A1 | 2/1990 | European Pat. Off. . |
| 0512487A1 | 11/1992 | European Pat. Off. . |
| 2193379A | 2/1988 | United Kingdom . |

OTHER PUBLICATIONS

Japanese Patent Abstract JP 1-34002 dated Feb. 3, 1989.

A. Sabban et al, "A New Broadband Stacked two-Layer Microstrip Antenna" *IEEE Transactions on Antennas and Propagation,* 1983, pp. 63-66.

*Primary Examiner*—Donald Hajec
*Assistant Examiner*—Hoanganh Le
*Attorney, Agent, or Firm*—Sughrue, Mion, Zinn, Macpeak & Seas

[57] ABSTRACT

The invention concerns a broadband antenna element for array antennas using microstrip technology. In accordance with the invention, an etched patch 2 on a dielectric substrate 1 is disposed at the bottom of a cavity 7 defined by conductive walls 8, cylindrical walls, for example, or walls of more complicated geometry. Depending on the embodiment, the conductive walls 8 can extend through the dielectric substrate 1 to form an electric contact with the ground plane 6 or a second resonator comprising a second etched patch 12 on a second thin dielectric substrate 11 may be placed in front of the cavity 7. The invention also applies to antenna subarrays constructed from a plurality of these antenna elements and to array antennas constructed from a plurality of these subarrays.

13 Claims, 7 Drawing Sheets

BROADBAND CAVITY-LIKE ARRAY ANTENNA ELEMENT AND A CONFORMAL ARRAY SUBSYSTEM COMPRISING SUCH ELEMENTS

BACKGROUND OF THE INVENTION

The invention concerns array antennas and especially broadband (5 to 10%) array antennas for aerospace applications in particular. These array antennas comprise many elements and their feed arrangements which are adapted to confer upon the radiated field the shape required for the specific intended application. There is therefore a requirement for an element that is cheap to manufacture (because large numbers are required, possibly up to several thousand), which are neither heavy nor bulky (because of the aerospace implications) and which are easy to integrate into the antenna (layout and feed geometry). Moreover, in new antenna designs there is the requirement to be able to dispose these elements on a conformed or possibly deformable surface.

In the field of satellite communications it is standard practice to use narrow or spot beams. This means that the main lobes of the radiated fields of the beam are relatively narrow and that beams of this type have a fairly small footprint on the ground. However, the main lobe can be formed in various ways, to create elongate or asymmetric footprints, for example. The requirement is usually to match the footprint on the ground to the geographical coverage area so that power is not wasted by radiating it unnecessarily outside this area. A lobe of an array antenna beam is formed by the geometry or the relative arrangement of the antenna elements and by the amplitude and the phase of the excitation signals applied to the elements by a feed array and its control electronics.

In the practical manufacture of array antennas several elements are often grouped together in subsystems which have a common control point in the amplitude and phase control system. FIG. 1 shows one example of a printed circuit feed array for four printed circuit antenna elements. An antenna element of this type is usually referred to as a "patch". Failing a monolithic global implementation, a subsystem may be constructed purely mechanically, forming the basic building block of a modular antenna structure, which facilitates maintenance and repair.

Printed circuit or plane array antennas made up an antenna elements have been known for at least 15 years and are used in increasingly varied application areas. Many patent and other publications define the state of the art in this field. Some of the better known references are listed below, and are hereby incorporated into this application as a description of the prior art:

1) MICROSTRIP ANTENNA TECHNOLOGY, K. Carver, J. W Mink, IEEE. AP vol AP 29.—N° 1 Jan. 1981.
2) ANNULAR SLOT ANTENNA WITH A STRIPLINE FEED, M. FASSET, 23 Jun. 1989—U.S. Patent.
3) A NEW BROADBAND STACKED TWO LAYER MICROSTRIP ANTENNA—A. Sabban—APS 1983—P63-66 IEEE.
4) ANTENNE PLANE (PLANE ANTENNA)—T. Dusseux, M. Gomez-HENRI, G. RAGUENET—French Patent N° 89 11829, 11 September 1989—Publ. FR 2 651 926.

These printed circuit array antenna systems are thus well known in their simple or multiresonator versions. Their main advantages, as compared with older array antennas made up of horn or helix type elements, are their compact size and low weight. Their great mechanical strength is also relevant in aerospace applications. On the other hand, the bandwidth of patch type elements is relatively small, up to around only a few percent in the simplest version.

SUMMARY OF THE INVENTION

One object of the invention is to obtain broadband operation, which is normally not possible with simple patch type elements, combined with the known advantages of this type of element.

It is known in the prior art to use a resonant cavity behind the patch to increase the bandwidth. In the prior art an element of this kind is usually fed by a "triplate" system comprising a conductive (feed) strip suspended between two ground planes. This solutions has the drawbacks that its mass and its overall size are greater than those of printed arrays and that its manufacturing costs are higher.

The proposed invention concerns an implementation of an antenna element for a plane antenna and antenna subsystems comprising such elements. The device in accordance with the invention can therefore be integrated into a plane array antenna and is particularly well suited to the implementation of an antenna subsystem of this kind on a conformed surface.

As will be explained in more detail later, one prior art way of increasing the bandwidth of patch type antenna elements is to increase the thickness of the dielectric between the patch and the ground plane. This method has the drawback that the resulting array of elements is more difficult to integrate with the radiating surface of the antenna, especially if this surface is conformed rather than planar. Also, the radiating characteristics of a thick plane antenna deteriorate very quickly, which is of limited operational advantage. Another object of the invention is therefore to overcome this drawback of the prior art to obtain broadband operation without commensurately complicating integration of the antenna with a conformed surface. The basic principle of the antenna element in accordance with the invention is shown in FIGS. 2A and 2B.

The antenna element comprises a metal cavity whose detailed geometry is optimized to suit the intended application of the antenna and an etched patch type resonator on a thin dielectric substrate.

The structure may therefore be regarded as a buried microstrip element.

The printed circuit elements known from the prior art, however simple they may be, have only limited possibilities in terms of bandwidth and radiation quality. A major defect concerns the repercussions of using a dielectric substrate whose thickness is increased to increase the bandwidth.

The bandwidth (BW) of an etched microstrip antenna is inversely proportional to its quality factor Q. The cavity of the prior art printed circuit element is formed by the patch, the dielectric between the patch and the ground plane, and the ground plane itself.

The bandwidth can be expressed as a function of the quality factor Q and the SWR (standing wave ratio). These parameters are related by the following equation:

$$BW = \frac{SWR - 1}{Q\sqrt{SWR}}$$

The Q is (approximately) inversely proportional to the standardized patch height t/λ where t is the thickness of the dielectric between the patch and the ground plane and λ is the electric wavelength in the dielectric which has the dielectric constant at the operating frequency of the antenna. Accordingly, over most of the curve defining the bandwidth as a function of the standardized height, for practicable thicknesses, the bandwidth is a linear function of t/λ, as shown by the curves reproduced in FIG. 3 from the Carver and Mink reference [1].

Applications using a bandwidth of only a few percent are rare (radar, for example). More generally, a bandwidth of 6 to 10%, or even more, is required and the simple resonator approach then requires thicknesses in excess of 15 λ for values of SWR close to 1.20.

The impact of this height is sometimes spectacular and includes undesirable effects such as:

loss of efficiency: ohmic losses, dielectric losses;

mediocre quality of the main polarization;

increase of crossed polarization to unacceptable levels;

propagation and radiation of surface waves, introducing unwanted coupling between adjacent elements.

A generally adopted upper limit for use of a simple etched resonator is a bandwidth of 4 to 5% for an SWR of 1.20. Beyond this bandwidth the solution also has a mass penalty in that virtually none of the wanted advantages of printed circuit antenna technology remain.

The man skilled in the art needing to increase the intrinsically low bandwidth of a printed circuit antenna is aware of the use of coupled multiresonator techniques (ref [3]—Albert Sabban). This yields multiple structures with bandwidth capacities from a few percent to a few tens of percent, if optimization is pushed in this direction. However, these advantages are obtained at the cost of greater complexity of implementation and of an antenna weight which increases in direct proportion to the number of resonators employed.

The invention is therefore directed to curing the drawbacks of the prior art and to providing a wide bandwidth using a simple technology derived from that of printed circuit "patch" antennas whilst retaining the advantages of this technology.

To this end the invention proposes a broadband patch type antenna element for an array antenna comprising a large number of said elements and at least one signal feed array therefor, said array(s) being implemented in the microstrip technology on a dielectric substrate, said antenna elements and feed array(s) being disposed on a front surface (in the radiation direction) of said substrate, a ground plane being disposed on the rear surface of said substrate, the antenna element being characterized in that it comprises an etched conductive patch on a dielectric substrate, said patch being placed in a cavity type closed system surrounding said patch.

In a preferred embodiment said closed system consists in a cylindrical conductive cavity disposed on the front surface of said dielectric substrate with said patch disposed at the bottom of said cavity which is open in the radiation direction of said element. In an alternative embodiment said system consists in a conductive cavity disposed on the front surface of said substrate but whose conductive walls extend through said substrate to the ground plane on the rear surface of said substrate, said cavity being open in the radiation direction of said element. In another embodiment the cavity of either of the previous embodiments is partially closed in the radiation direction by a second resonator which consists in an etched conductive patch on a support which is then disposed on the front surface of said conductive cavity. In various embodiments the microstrip feed line may be implemented either as a simple microstrip or as a screened or channel microstrip and may enter said cavity either via a channel recessed into the metal cavity or via an opening formed in the wall of said cavity.

Various patch shapes may be used, for example: circle, square, polygon, etc; as can various cavity shapes: circular, square, octagonal, pentagonal, hexagonal, etc. cylinder.

The invention also proposes a subset or subarray of antenna elements for an array antenna, said subarray including a mechanical support, a plurality of patches and their microstrip feed arrangements with their associated dielectric substrate and ground plane, characterized in that said subarray mechanical support is disposed on the front surface of said dielectric substrate on the radiating side of the antenna. In one subarray embodiment the antenna elements are as described above and further comprise a resonator system around each patch, said resonator system comprising a cavity, for example. In a preferred embodiment said mechanical support comprises said cavity. In a particularly advantageous embodiment said subsystem is fed by a single feed point common to all the elements of said subarray. In a large geometry embodiment said subarray is conformed rather than planar, i.e. the patches of a subarray can have different angular orientations.

The invention also concerns the integration of subarrays as described above into an array antenna. In various embodiments said antenna may be disposed on a plane surface, a surface the shape of a body of revolution or a surface having any curvature. The subarrays used in the array antenna advantageously have identical geometries enabling volume production of the components of said subarrays and of the subarrays themselves.

Other features, embodiments and advantages of the invention will emerge from the following detailed description.

DETAILED DESCRIPTION OF THE PREFERRED EMBODIMENTS

Figure 1:
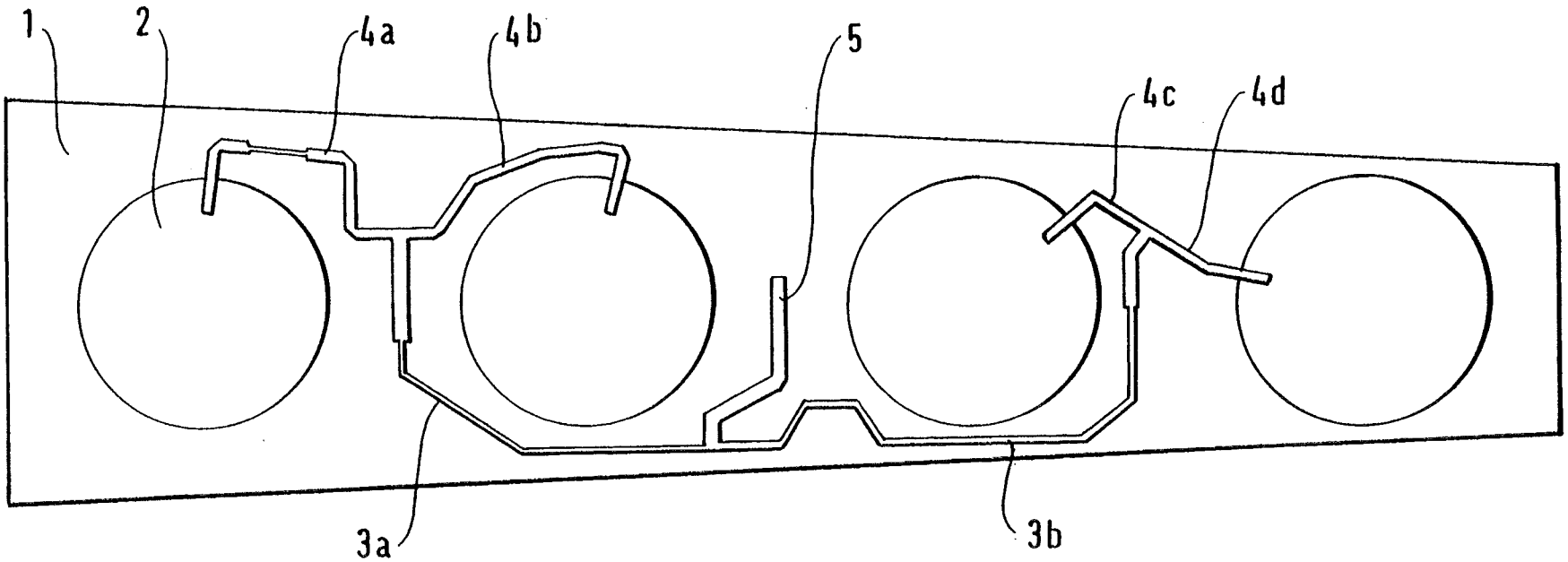
FIG. 1, already described, a diagrammatic plan view of a subarray of four antenna patches in accordance with the invention and their microstrip feed arrangement.

In the various figures the same reference numbers denote the same parts and the embodiments described and shown in the drawings are described and shown by way of non-limiting example only.

FIG. 1 shows one example of a subarray of four patch type antenna elements 2 printed on a dielectric substrate 1. The four antenna elements or patches are fed by a microstrip feed array comprising conductive strips printed or etched on the same dielectric substrate 1. In this example the four patches are fed from a common point 5 which feeds two branches 3*a*, 3*b* which thereafter bifurcate into sub-branches 4*a*, 4*b*, 4*c*, 4*d*. Depending on the relative length of the electrical paths travelled to each patch by the signals applied to the input 5 of the feed array, the relative phase with which the four patches are excited constitutes a variable parameter. The relative excitation amplitude can also be controlled by controlling the various impedances of the various paths. These considerations of antenna design are well known to the man skilled in the art and will not be explained further in the context of the present application.

Figure 2A:
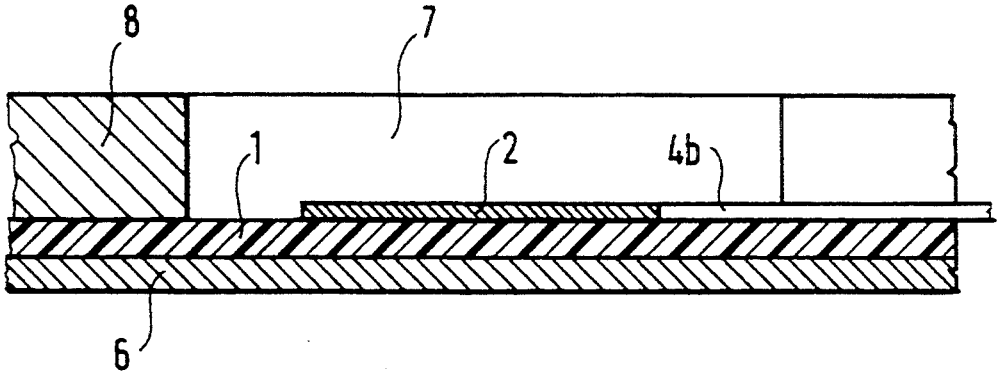
FIGS. 2A and 2B, already described, are diagrammatic plan view in cross-section of one embodiment of an antenna element in accordance with the invention.
Figure 2B:
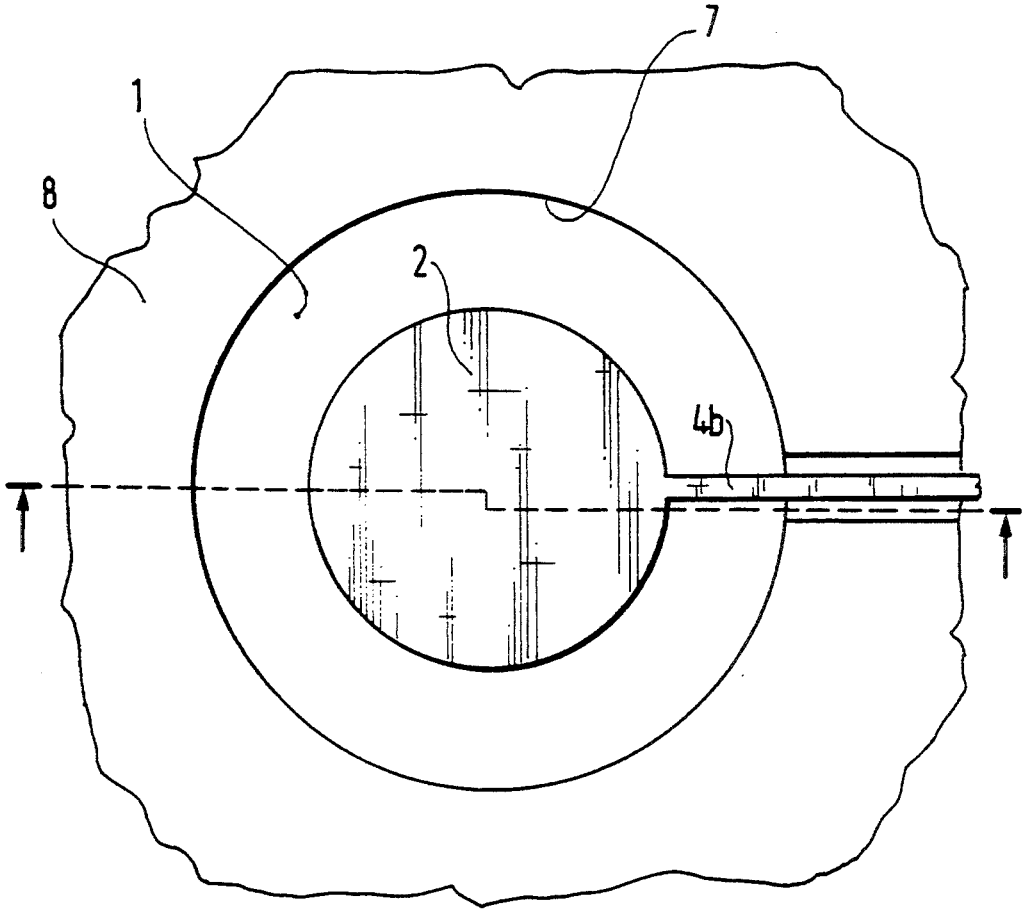

FIGS. 2A and 2B show one embodiment of an antenna element in accordance with the invention. By way of example, it is assumed that this element comprises an etched conductive patch 2 on a dielectric substrate 1 with a ground plane 6 on its rear surface. The patch 2 is fed by the microstrip 4*b* which is an etched conductive track, usually of the same material as the patch. In accordance with the invention the patch 2 is at the bottom of a closed system comprising (for example) a cavity 7 defined by conductive walls 8 delimiting the radial size of the cavity 7 around the patch 2. The dimensions of the cavity 7 determine its radio frequency properties according to rules which are well known to the man skilled in the art; consequently, these dimensions may be chosen by the designer to obtain the required bandwidth at the operating frequency of the antenna element without increasing the thickness of the dielectric 1 behind the patch 2. Accordingly, the sizing of the antenna element of the antenna in accordance with the invention as shown in the simplest possibly form in FIG. 2 is not governed by the same mechanisms as practical sizing in the prior art.

Figure 3:
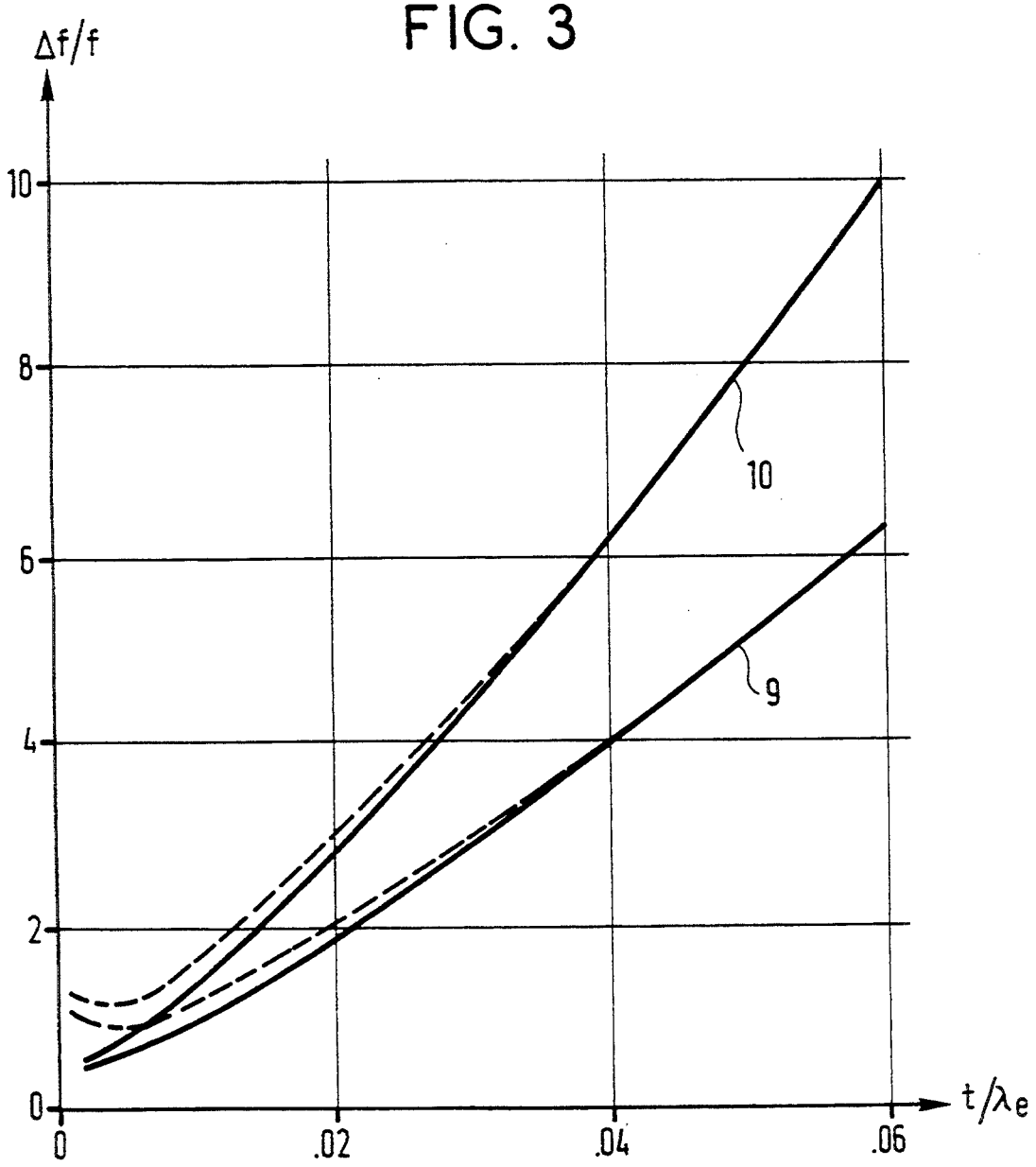
FIG. 3, already described, shows curves of bandwidth as a function of the standardized dielectric height for square and rectangular patches for a standing wave ratio SWR=2 and for frequencies 1 GHz and 10 GHz (reference 1).

FIG. 3 shows, for a prior art structure, curves of the bandwidth $\Delta f/f$ as a function of the standardized height $t/\lambda$ of the dielectric, i.e. the thickness of the dielectric is "standardized" or divided by the wavelength $\lambda$ in the dielectric. These curves show that an unacceptable thickness of dielectric is needed to achieve a bandwidth in excess of a few percent. The curve 9, for example, shows the frequency response of a square patch whose side length is equal to 0.3 $\lambda_0$ (where $\lambda_0$ is the wavelength in vacuum) on a dielectric substrate having a dielectric constant $_r$=2.76 and for an SWR (standing wave ratio) of 2. The curve 10 shows the frequency response of a rectangular patch whose side lengths are equal to $0.3\times0.5\ \lambda_0$, with the same dielectric constant and SWR parameters. Note that at microwave frequencies on the order of 1 to 10 GHz, indicated respectively on the curves 9 and 10 by a continuous line and a dashed line, there is an approximately linear relationship between the bandwidth and the standardized height for bandwidths between 1% and 10%.

In the case of the invention, however, and as shown in FIG. 2, the situation is more like a microstrip propagation line to mini-waveguide transition, the fundamental aspects of behavior therefore obeying specific rules described below.

The main propagation line is therefore of the microstrip type and is typically a conductive strip etched on a dense substrate whose thickness is determined according to the usual radio frequency criteria ( $_r$, w, h, Ze) and more specific constraints relating to the intended application. The benefit of a thin substrate (here thin means on the order of 20 mils thick, 30 mils maximum, i.e. from 0.5 to 0.75 mm) is that it makes entirely feasible industrial manufacture of the antenna elements and their associated distribution circuits, on plane surfaces, of course, but also and most importantly on surfaces conformed in three dimensions, as will be explained later.

An embodiment of an array antenna on a conformed surface where the use of antenna elements in accordance with the invention is extremely attractive will be described in more detail.

Figure 4A:
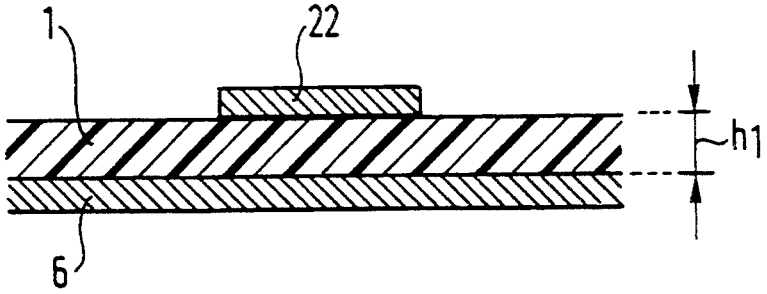
FIGS. 4A and 4B are diagrams showing in cross-section a simple microstrip feed line (4A) and a screened microstrip feed line (4B).
Figure 4B:
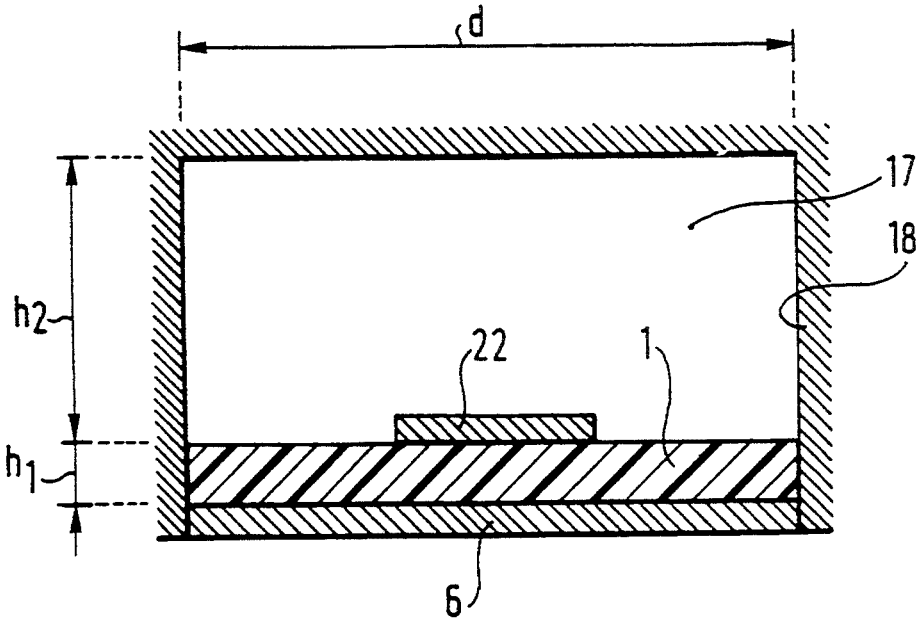

FIGS. 4A, 4B show two examples of microstrip technology which can be used to implement feed lines for antenna elements in accordance with the invention. In FIG. 4A the microstrip line comprises an etched conductive strip 22 on a dielectric substrate 1 having a ground plane 6 on the back of the substrate (on the side opposite the side carrying the etched strip). The physical parameters characterizing this system are the dielectric constant and the height or thickness $h_1$ of the dielectric.

FIG. 4B shows a screened microstrip 9 in diagrammatic form. As in the previous case, the microstrip line itself comprises an etched conductive strip 22 on a dielectric substrate 1 having a ground plane 6 on the back of the substrate 1. A screen around this line is provided by conductive walls 18 which surround the strip 22 and which are electrically connected to the ground plane 6.

The physical parameters which characterize the system are the dielectric constant and the height or thickness $h_1$ of the dielectric, together with the dimensions of the screen: the height $h_2$ or the distance between the surface of the dielectric 1 and the conductive wall 18 parallel to this surface and the width d between the conductive walls 18 on each side of the track 22. The space 17 inside the screen formed by the conductive walls 18 is assumed to be filled with air and therefore to have a dielectric constant close to unity. The radio frequency propagation characteristics of a line of this kind are calculated on the basis of the physical parameters mentioned using methods well known to the man skilled in the art.

In a practical implementation of an antenna element in accordance with the invention this simple or "screened" line using a channel technology opens into a cavity and is significantly altered in order to form a patch geometry.

The simplest cavity shape is a cylinder but other geometries may be used to suit the application (square, pentagonal, hexagonal, etc) without this being limiting in any way.

The same goes for the geometry of the patch which may be a simple circle or a simple square in the simplest version but is open to alteration to yield geometries limited only by the imagination of the designer. For example, judiciously sized alterations to radiate a circularly polarized wave, for example notches or bevels, or even more exotic geometries.

The characteristics of this patch and those of the metal cavity surrounding it, or rather those implementing a metal type condition on the fields E and H then enable, by a judiciously sized combination of the two, respective size, overall size, treatment, etc, an orthogonal type transition from the microstrip line to the miniwaveguide having the required characteristics:

compact size, wide bandwidth.

Many parameters which were not available in the case of a patch with no cavity can be used to optimize particular aspects of performance, whether in terms of impedance or radiation. These are mainly:

the average size of the cavity, the average height of the cavity.

For example, the directionality of an antenna element in accordance with the invention is determined by the relative sizes of the patch and the cavity surrounding it.

This flexibility of sizing is inconceivable in the prior art simple resonator context but becomes possible through combining patches and cavities in accordance with the invention. It is clear that the laws governing its behavior are modified and that new multi-variable curves can be established empirically, similar to those shown in FIG. 3.

Matching performance is no longer governed by the same laws and use of the cavity significantly improves the SWR performance. In one practical embodiment constructed by the inventor, a typical bandwidth of 6 to 8% was obtained with an SWR of 1.20 in the L band (1.5 GHz) using a structure whose total thickness did not exceed 10 mm (typically 6 mm), which qualifies the design for inclusion in the category of thin antennas.

A patch and cavity environment of this kind provides screening which has two main consequences:

securing the quality of radiation and the array configuration, the use of cavities minimizing interelement coupling.

absence of the disturbing mechanism associated with the generation of surface waves in the dielectric. These surface waves conventionally propagate in the structure and can disturb the behavior of adjoining elements. In an implementation in accordance with the invention the surface waves are "trapped" in the cavity and contribute to the general antenna matching mechanism.

Two technological implementations of the inventive concept are feasible. This concept consists in combining a cavity and the buried microstrip technology antenna element.

The first approach is consistent with FIG. 2. In this case the cavity may be integrated into a supporting structure (such as that shown in FIG. 8, for example) to which the microstrip circuit on a thin dielectric substrate 1 comprising the patch 2 and the feed line 4 is glued, screwed or fastened by any other means.

Figure 5:
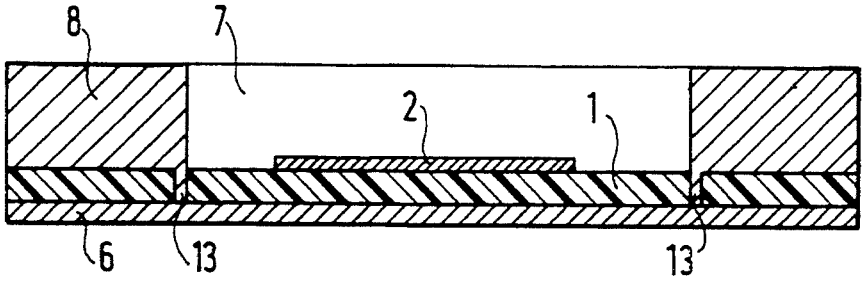
FIG. 5 is a diagram showing in cross-section one embodiment of an antenna element in accordance with the invention.

FIG. 5 is a view in cross-section of one embodiment of the invention. This figure is identical to FIG. 2 except for the presence of the conductive elements 13. In this embodiment a short-circuit is achieved between the vertical wall 8 of the cavity 7 and the ground plane 6 of the microstrip line by one or more conductive member(s) 13 which connect them electrically. This implementation therefore provides total screening of the microstrip and patch combination from adjoining elements. The electrical continuity secured by the conductive element(s) 13 may be total or partial:

Total continuity: The metal structure 8 defining the cavity 7 may be welded or brazed to the backplane 6 according to the geometry of the cavity.

Partial continuity: A discrete screen is feasible using studs through the dielectric substrate 2 which can be screwed to the cavity, or consideration could be given to the technique of plated-through holes in the dielectric substrate which could be vapor phase soldered to the continuity member of the cavity, for example.

Another technique could achieve an equivalent electrical condition. The cavity could be given a geometry facing the ground plane such that it constitutes a reactive short-circuit for microwave signals. A technique of this kind has already been disclosed in reference [4] (French patent N° 89 11829).

From the basic concept of combining a patch/microstrip feed line assembly with a cavity, it is possible to build many variants which are no more than specific applications or optimizations of the novel concept. This assertion is illustrated by two examples.

a) a very wide bandwidth element, developed for the X band.

b) a conformed array using the type of element shown in FIG. 2.

Figure 6:
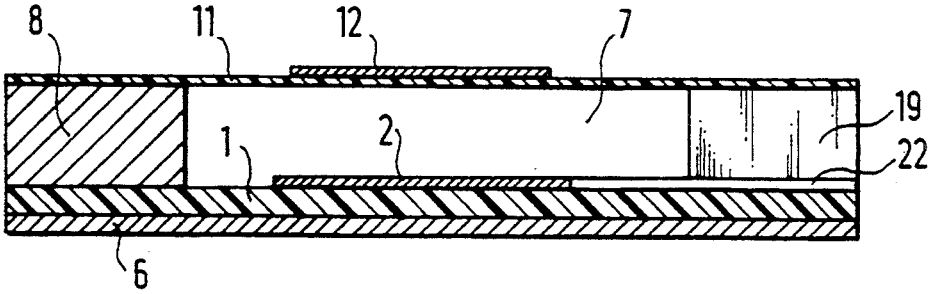
FIG. 6 is a diagram showing in cross-section another embodiment of an antenna element in accordance with the invention with a second resonator.

FIG. 6 shows a first embodiment of an antenna using a very wide bandwidth element in accordance with the invention. This element was designed for an antenna operating at 8 GHz which has been constructed and on which measurements have been carried out to confirm the expected performance.

FIG. 6 shows how this implementation is put into effect. It entails adding to a basic antenna patch 2 a second resonator 12 disposed over the first resonator 2. The configuration is therefore that of FIG. 2 except that the resonator cavity 7 is partially closed at the front by a second resonator 12 which may be a printed patch on a dielectric support 11, for example. In this specific case the second element is flush with the cavity 7 but, subject to more elaborate constructional arrangements, it could be at a greater or lesser distance than the height of the conductive walls 8 of the cavity 7.

However, the approach whereby the interpatch distance and the height of the cavity are exactly the same greatly simplifies the implementation from the technological point of view. The second resonator 12 may be etched on a thin, light supporting substrate 11 and it may be glued or screwed in place.

In the FIG. 6 embodiment the main specifications of the antenna element are as follows:

Cavity 7 diameter: 23 mm

Cavity 7 height: 2 mm

1st resonator 2 size: 14 mm approx.

Substrate 1 permitivity: 2.50 approx. (1st resonator)

1st substrate 1 thickness: 20 mils=0.508 mm

2nd resonator 12 size: 14 mm approx.

Substrate 11 permitivity: 3.90 approx.

2nd substrate 11 thickness: 125 μm approx.

Figure 7:
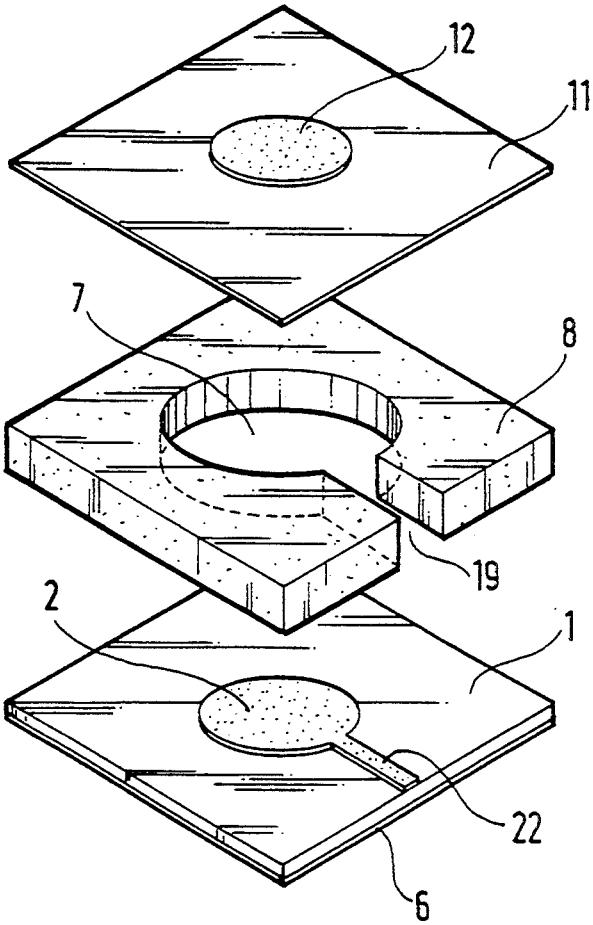
FIG. 7 is an exploded perspective view of a variant of the FIG. 6 embodiment.

FIG. 7 is an exploded view of the FIG. 6 embodiment. It shows that two resonators can be altered by means of bevels in order to generate circular polarization using a single input, if required. The radiation diagrams as measured in an application bandwidth from 8.0 to 8.4 GHz show excellent device behavior. The ellipticity (crossed polarization) is excellent at the optimizing frequency (8.2 GHz) and remains very much below 3 dB for all of the wanted band.

FIG. 7 also shows the opening 19 formed on one side of the conductive wall 18 of the resonant cavity to enable the microstrip feed line to enter the cavity.

Figure 8:
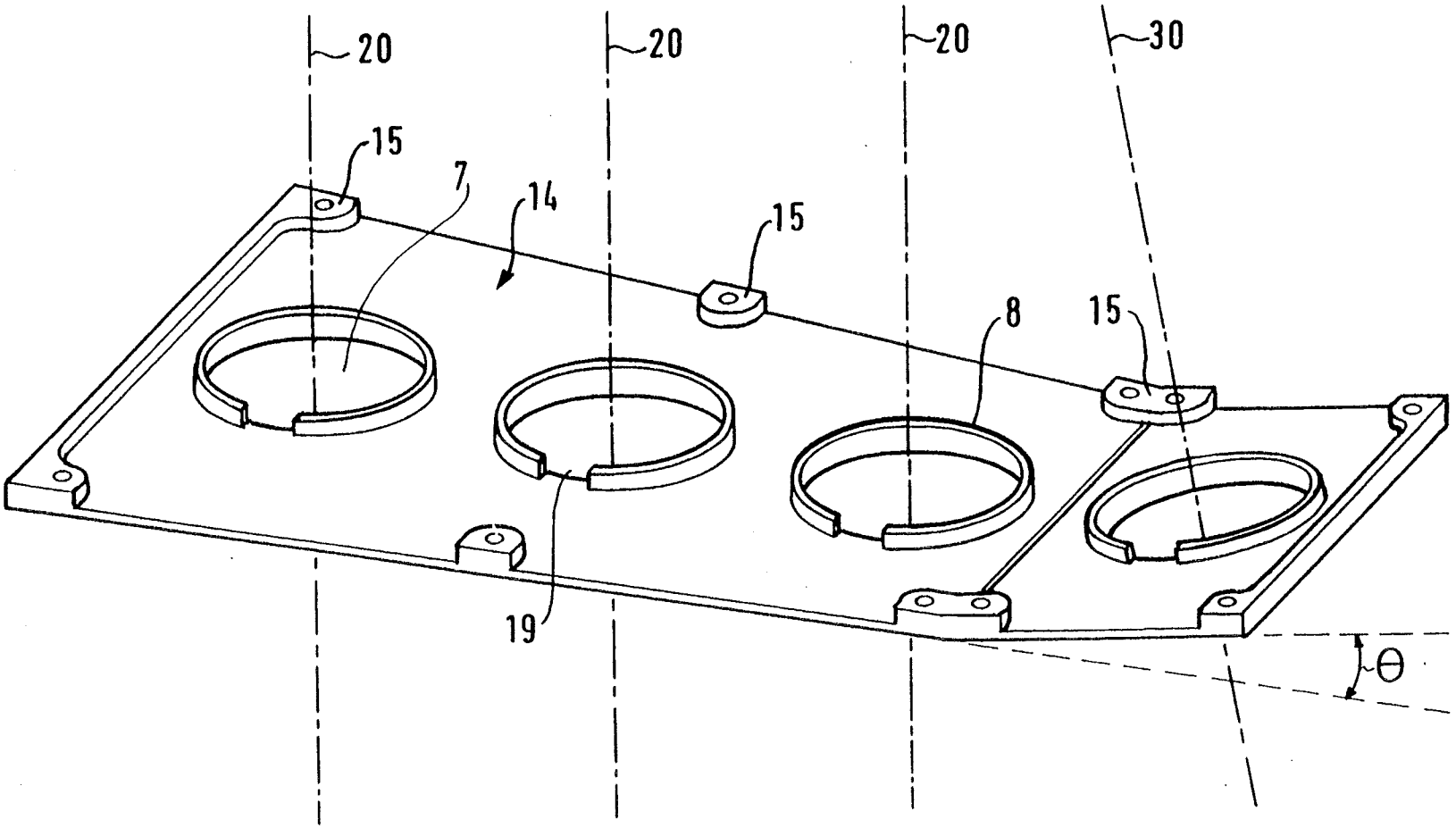
FIG. 8 is a diagrammatic perspective view of one example of a mechanical structure for an antenna subsystem in accordance with the invention.
Figure 9:
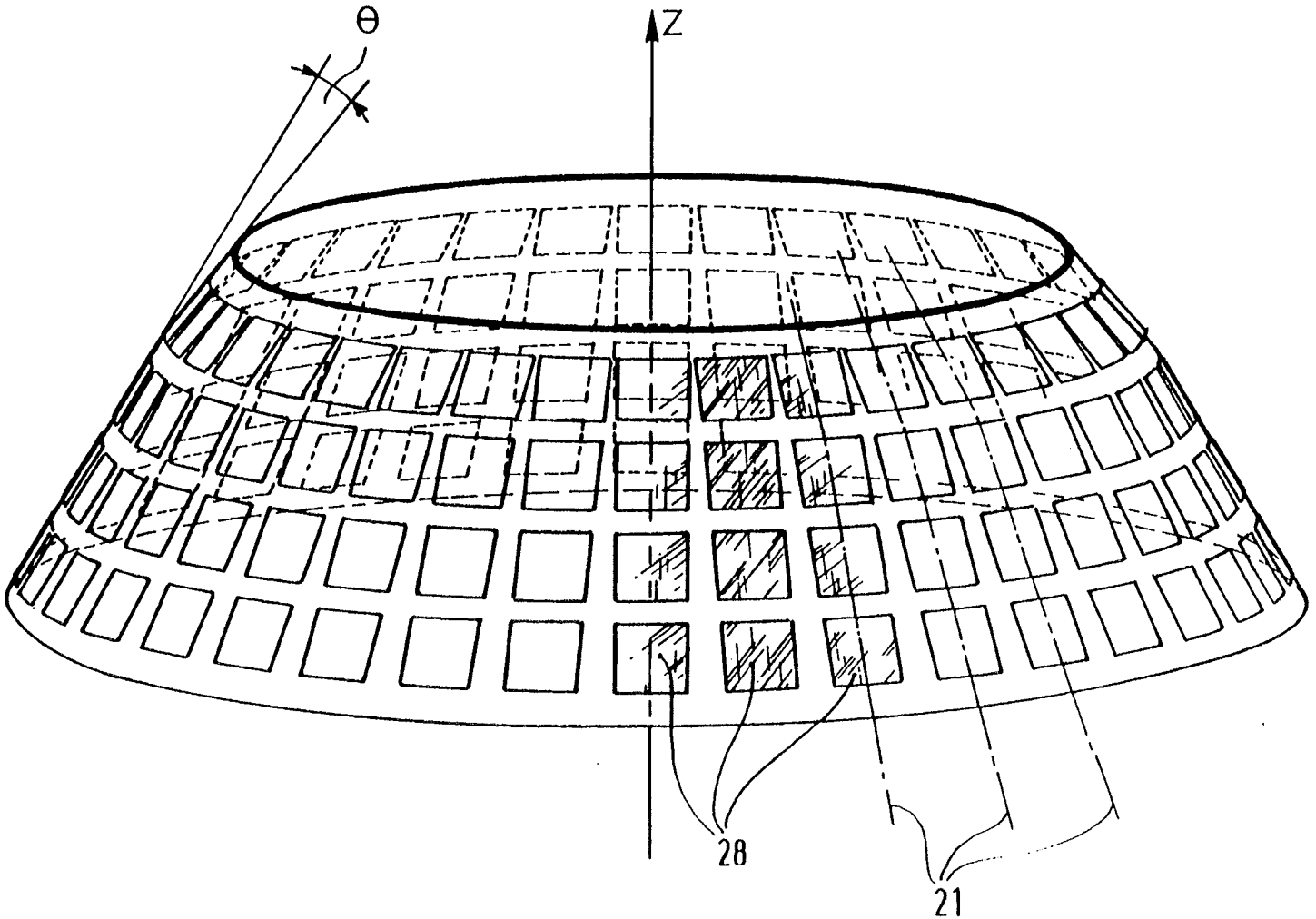
FIG. 9 is a diagram showing the implementation of an array antenna on a conformed surface using subarrays of antenna elements in accordance with the invention.

An antenna design in which the antenna element in accordance with the invention and shown in FIGS. 2 and 5 through 7 can be used provides an electronically scanned antenna as shown in FIGS. 8 and 9. FIG. 8 is a diagrammatic perspective view of a mechanical structure of an antenna subsystem in accordance with the invention, this subsystem being adapted to be assembled together with numerous similar subsystems to form an array antenna as shown in FIG. 9.

FIG. 9 shows the operating principle of the antenna. The example of a complete array thus consists in the implementation on a surface which is a symmetrical body of revolution about a z axis of identical subassemblies like that shown in FIG. 8. In this embodiment the subsystems comprise four identical patch type antenna elements as shown in any of FIGS. 2 and 5 through 7 fed by a common distributor arrangement as shown in FIG. 1. The mechanical structure 14 shown in diagrammatic plan view in FIG. 8 comprises the conductive walls of the four cavities 8 and fixing studs 15 for the microstrip circuit and its dielectric substrate 1 as shown in FIG. 1. Openings 19 are provided in the conductive walls 8 for the microstrip feed lines of the antenna elements.

The topology of the antenna elements is special in the example shown in FIGS. 8 and 9 to the extent that one is inclined at an angle $\theta=10°$ to the other three. FIG. 8 shows that the three axes 20 of the first three cavities are parallel whereas the axis 30 of the fourth cavity is inclined at 10° to the others. The subarray is therefore conformed rather than planar. Thanks to the thinness of the dielectric 1 which is a result of using the invention the microstrip circuit can easily be deformed to glue it to the mechanical structure 14, once fixed to the latter by means of the fixing studs 15.

FIG. 9 shows one embodiment of an array antenna made up of subarrays as shown in FIG. 8. The subarrays themselves are made up of a certain number of antenna elements 28 in accordance with the invention (four in this example) aligned on the subarray axis 21; to build the antenna each subarray is disposed with its axis 21 in the same plane as the main axis z of the antenna and with a constant angular offset between each pair of successive planes defined in this way. The angle $\theta$ is 10° as in FIG. 8. The benefit of this particular topology is that it contributes to the formation of the radiating lobe of the antenna as described in French patent application N° 91 05510 of 6 May 1991 in the name of the applicant (which is hereby incorporated into the present application as a description of the prior art concerning shaped lobe array antennas).

The benefit of the new antenna element concept in implementing this kind of antenna is clear. The advantages include:

1) The cavity provides a screen which eliminates all problems of mutual coupling and enables optimum array configuration, with the optimum pitch between elements.

2) The microstrip technology procures two other major advantages:

a) the radiating transition is very compact;

b) the feed arrangement can be implemented on the conformed surface.

Because it is thin (20 mils) the etched dielectric support can easily be hot-formed (for example) without problems in respect of radio frequency operation. Other technologies like the triplate technology, for example, would be either unusable or very difficult to use.

The benefit of the proposed approach is therefore clear as it makes it possible to solve simultaneously all the technical problems that arise:

a) easy implementation of very compact broadband antenna elements on surfaces that can be conformed: cone, sphere or other shapes dependent on the application. By design these antenna elements are screened by electrical walls: cavities which secure their own operation and their array configuration.

b) Easy implementation of a distribution arrangement on a non-planar surface. Essentially, a microstrip type technology is very well suited to being conformed and accordingly is very useful in the application examples discussed above. For example, FIG. 1 shows the implementation mask of a lower microstrip circuit which can be used to implement an antenna subsystem in accordance with the invention. It shows the four circular antenna elements (for operation in the X band in this example) and the various components of the distribution circuit including a series of transformers and power splitters. Microstrip type propagation relies on an asymmetrical field distribution and concentrates the fields between the strip and the dielectric. Accordingly, it is entirely suited to a non-planar topology and the feed is distributed without significant disturbance and without any major technological problems.

It is clear that the configurations described are not limiting on the invention and that the concept could be applied in as many variations as there are potential applications.

Thus in connection with the examples of array antennas proposed, they may comprise a greater number of elements, be implemented in a planar manner or be used to sample a reflector antenna and in this case to be laid out on a Petzwald surface type geometry which optimizes the efficiency of the device.

We claim:

1. A broadband patch-type antenna element for an array antenna comprising a large number of antenna elements and at least one feed array for feeding signals to said antenna elements, said feed array being implemented in microstrip technology on a dielectric substrate, said antenna elements and feed array being disposed on a from surface, in the radiation direction, of said substrate, a ground plane being conformally disposed on the rear surface of said substrate, the patch-type antenna element being characterized in that it comprises:

an etched conductive patch on a dielectric substrate, said patch being disposed in a closed cavity-like volume which enables operation of the antenna element to be optimized; and a resonating system comprising a cavity defined by conductive walls lying substantially perpendicular to said patch, said cavity being disposed on the front surface of said dielectric substrate, said patch being disposed at the bottom of said cavity, and said conductive walls of said cavity extending through said substrate to the ground plane.

2. The antenna element according to claim 1, characterized in that said cavity is open in the radiation direction of said antenna element.

3. The antenna element according to claim 1, characterized in that said cavity is partially closed in the radiation direction by a second resonator which comprises an etched conductive patch on a second thin dielectric substrate disposed on the front surface of said cavity.

4. The antenna element according to claim 1, characterized in that said microstrip feed array is a simple microstrip.

5. The antenna element according to claim 1, characterized in that said microstrip feed array is a screened microstrip.

6. A subarray of antenna elements for an array antenna including a mechanical support, a plurality of patches and corresponding microstrip technology feed arrangements disposed on an associated dielectric substrate which is conformally disposed on an associated ground plane, said subarray characterized in that said mechanical support is disposed on a front surface of said dielectric substrate on a radiating side of the antenna, and wherein each of the antenna elements comprises: an etched conductive patch on said dielectric substrate, said patch being one of said plurality of patches; and conductive walls lying substantially perpendicular to said patch and forming a cavity, said conductive walls extending through said dielectric substrate to the ground plane.

7. The antenna subarray according to claim 6 characterized in that said mechanical support 14 comprises conductive walls of said cavity.

8. The antenna subarray according to claim 6 or claim 7 characterized in that said subarray is fed from a single feed point common to all the antenna elements of said subarray.

9. The antenna subarray according to claim 6 or claim 7 characterized in that said subarray is conformed rather than planar.

10. An array antenna characterized in that the array antenna comprises antenna subarrays according to claim 6.

11. The array antenna according to claim 10, characterized in that said antenna is disposed on a surface in the shape of a body of revolution.

12. The array antenna according to claim 10, characterized in that said antenna is disposed on a conformed surface.

13. The array antenna according to any one of claims 10, 11 and 12 characterized in that said antenna is made up of subarrays having exactly the same geometry.

* * * * *